US008912377B2

(12) United States Patent
Kim et al.

(10) Patent No.: US 8,912,377 B2
(45) Date of Patent: Dec. 16, 2014

(54) METHOD FOR PRODUCING HIGH VALUE AROMATICS AND OLEFIN FROM LIGHT CYCLE OIL PRODUCED BY A FLUIDIZED CATALYTIC CRACKING PROCESS

(75) Inventors: Cheol Joong Kim, Daejeon (KR); Tae Jin Kim, Daejeon (KR); Do Woan Kim, Daejeon (KR); Sung Won Kim, Seoul (KR); Sang Hun Oh, Seoul (KR); Sam Ryong Pakr, Daejeon (KR); Seung Hoon Oh, Seoul (KR); Yoon Kyung Lee, Chungcheongbuk-do (KR); Gyung Rok Kim, Daejeon (KR); Hong Seok Jung, Daejeon (KR); Eun Kyoung Kim, Daejeon (KR); Byoung In Lee, Daejeon (KR); Dae Hyun Choo, Busan (KR)

(73) Assignee: SK Innovation Co., Ltd., Seoul (KR)

( * ) Notice: Subject to any disclaimer, the term of this patent is extended or adjusted under 35 U.S.C. 154(b) by 15 days.

(21) Appl. No.: 13/124,406

(22) PCT Filed: Oct. 7, 2009

(86) PCT No.: PCT/KR2009/005711

§ 371 (c)(1),
(2), (4) Date: Apr. 15, 2011

(87) PCT Pub. No.: WO2010/044562

PCT Pub. Date: Apr. 22, 2010

(65) Prior Publication Data

US 2011/0207979 A1 Aug. 25, 2011

(30) Foreign Application Priority Data

Oct. 7, 2008 (KR) ..... 10-2008-0102130

(51) Int. Cl.
*C10G 11/02* (2006.01)
*C07C 4/06* (2006.01)
(Continued)

(52) U.S. Cl.
CPC ..... *C10G 11/18* (2013.01); *C10G 11/02* (2013.01); *C10G 11/04* (2013.01);
(Continued)

(58) Field of Classification Search
CPC ..... C07C 4/00; C07C 4/02; C07C 4/06; C07C 5/10; C07C 5/11; C07C 11/02; C07C 11/04; C07C 11/06; C07C 11/08; C07C 15/02; C07C 15/04; C07C 15/06; C07C 15/067; C07C 15/08
USPC ..... 585/256, 266, 269, 270, 273, 274, 275, 585/276, 324, 653, 315, 319, 476; 208/67, 208/69, 70, 143, 299, 106, 107, 108, 109; 502/79
See application file for complete search history.

(56) References Cited

U.S. PATENT DOCUMENTS 3,065,166 A * 11/1962 Hennig ..... 208/67
(Continued)

FOREIGN PATENT DOCUMENTS

CN 1425055 A 6/2003
(Continued)

OTHER PUBLICATIONS

Gunter Alfke et al., "Oil Refining," Jan. 15, 2007, Wiley-VCH, Ullmann's Encyclopedia of Industrial Chemistry, p. 215-221.*
(Continued)

*Primary Examiner* — In Suk Bullock
*Assistant Examiner* — Philip Louie
(74) *Attorney, Agent, or Firm* — Richard M. Klein; Fay Sharpe LLP

(57) ABSTRACT

The present invention relates to a method of producing aromatic products (benzene/toluene/xylene) and olefin products from petroleum fractions obtained by fluid catalytic cracking, and, more particularly, to a method of producing products comprising high-concentration aromatic products and high value-added light olefin products from light cycle oil obtained by fluid catalytic cracking.

8 Claims, 1 Drawing Sheet

(51) Int. Cl.

| | |
|---|---|
| ***C10G 11/18*** | (2006.01) |
| ***C10G 11/04*** | (2006.01) |
| ***C10G 11/05*** | (2006.01) |
| ***C10G 45/44*** | (2006.01) |
| ***C10G 45/46*** | (2006.01) |
| ***C10G 45/48*** | (2006.01) |
| ***C10G 69/04*** | (2006.01) |
| ***C10G 69/06*** | (2006.01) |

(52) U.S. Cl.

CPC ..... *C10G 11/05* (2013.01); *C10G 45/44* (2013.01); *C10G 45/46* (2013.01); *C10G 45/48* (2013.01); *C10G 69/04* (2013.01); *C10G 69/06* (2013.01); *C10G 2400/20* (2013.01); *C10G 2400/30* (2013.01); *C10G 2300/4081* (2013.01)

USPC ..... 585/256; 585/266; 585/269; 585/270; 585/275; 585/276; 585/324; 585/315; 585/319

(56) References Cited

U.S. PATENT DOCUMENTS

| | | | | | |
|---|---|---|---|---|---|
| 3,271,418 | A | * | 9/1966 | Plank et al. | 208/120.15 |
| 3,755,141 | A | * | 8/1973 | Youngblood et al. | 208/56 |
| 4,618,412 | A | * | 10/1986 | Hudson et al. | 208/59 |
| 4,738,766 | A | * | 4/1988 | Fischer et al. | 208/68 |
| 4,921,595 | A | * | 5/1990 | Gruia | 208/59 |
| 4,954,242 | A | * | 9/1990 | Gruia | 208/99 |
| 4,983,273 | A | * | 1/1991 | Kennedy et al. | 208/89 |
| 4,985,134 | A | * | 1/1991 | Derr et al. | 208/84 |
| 5,007,998 | A | * | 4/1991 | Gruia | 208/59 |
| 5,951,850 | A | * | 9/1999 | Ino et al. | 208/120.01 |
| 6,149,800 | A | | 11/2000 | Iaccino et al. | |

FOREIGN PATENT DOCUMENTS

| | | | |
|---|---|---|---|
| EP | 0944693 | B1 | 9/2000 |
| EP | 1734098 | A1 * | 12/2006 |
| JP | 61-148295 | | 7/1986 |
| JP | 03-002128 | | 1/1991 |
| JP | 04-500231 | | 1/1992 |
| JP | 2003-53048 | | 10/2003 |
| JP | 2004-261628 | | 9/2004 |
| KR | 10-2006-0133777 | A | 12/2006 |
| KR | 10-2007-0018836 | A | 2/2007 |
| WO | WO2006/137615 | A1 | 12/2006 |

OTHER PUBLICATIONS

International Search Report and translation for WO 2010/044562 dated Apr. 22, 2010.

Auerbach et al., "Handbook of Zeolite Science and Technology", © 2003, Marcel Dekker, Inc., New York.

Office Action for corresponding Japanese Application No. JP 2011-532013 dated Jan. 14, 2014; English translation attached.

* cited by examiner

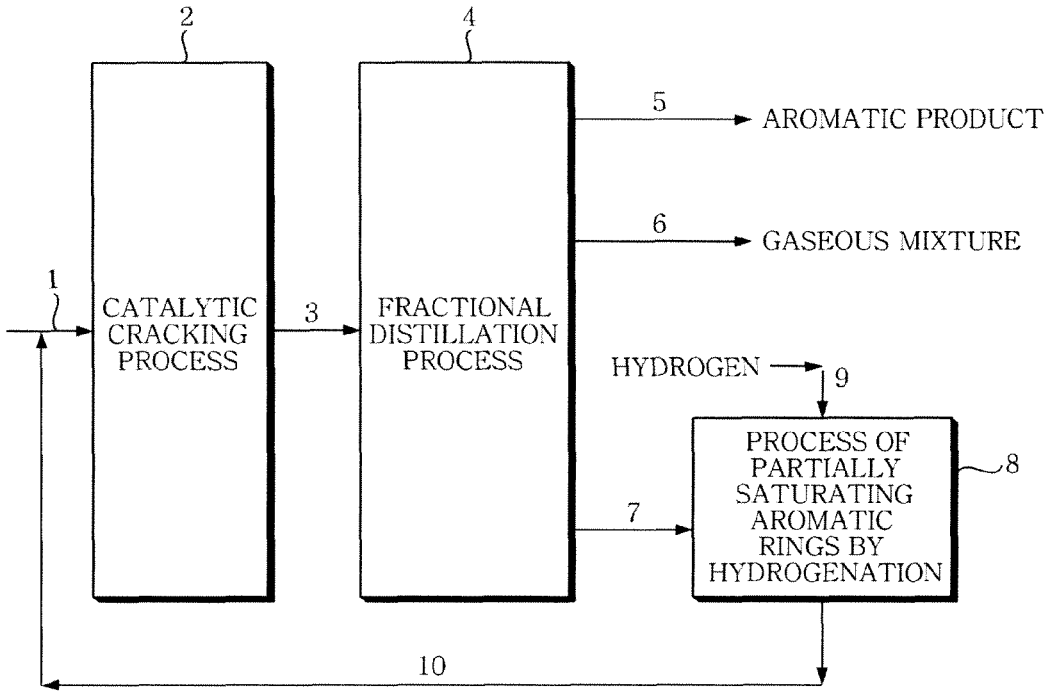
2
4
5
AROMATIC PRODUCT
6
GASEOUS MIXTURE
1
CATALYTIC CRACKING PROCESS
3
FRACTIONAL DISTILLATION PROCESS
HYDROGEN
9
PROCESS OF PARTIALLY SATURATING AROMATIC RINGS BY HYDROGENATION
8
7
10

METHOD FOR PRODUCING HIGH VALUE AROMATICS AND OLEFIN FROM LIGHT CYCLE OIL PRODUCED BY A FLUIDIZED CATALYTIC CRACKING PROCESS

TECHNICAL FIELD

The present invention relates to a method of producing aromatics (benzene/toluene/xylene) and olefins from petroleum fractions obtained by fluid catalytic cracking, and, more particularly, to a method of producing products comprising high-concentration of aromatic products and high value-added light olefin products from light cycle oil obtained by fluid catalytic cracking.

BACKGROUND ART

Conventionally, aromatic products (benzene/toluene/xylene) have been produced by hydrogenating and extracting pyrolysis gasoline, which is produced together with basic petroleum fractions such as ethylene, propylene and the like in a naphtha cracking center using naphtha as a raw material, or by preparing reformate from naphtha through catalytic reforming and then extracting the reformate therefrom.

However, this conventional method of producing aromatic products is problematic in that it cannot cope with the increase in demand because only naphtha, which is a petroleum fraction having a narrow boiling point range and produced by the ordinary distillation of crude oil, is used.

Fluid catalytic cracking (FCC) is a typical process of producing gasoline from heavy oil. Recently, more facilities for FCC have been established.

Examples of products produced by FCC include propylene, methyl tertiary butyl ether (MTBE), alkylates, light cracked naphtha (LCN), heavy cracked naphtha (HCN), light cycle oil (LCO slurry oil (SLO), etc. These products are respectively used as a raw terial for synthetic resin (PP), an oxygen-containing fraction for gasoline, a high-octane fraction for gasoline, a blending agent for gasoline, a blending agent for light oil/heavy oil, a blending agent for heavy oil, a blending agent for heavy oil, etc. Particularly, among these products, LCO can be used as an alternative to naphtha because it contains a large amount (70% or more) of aromatic components of one or more aromatic rings. However, LCO is not suitable as a raw material to be used in a conventional process of producing aromatic products using naphtha because heavy aromatic components of two or more aromatic rings must be converted into aromatic components of one aromatic ring and because catalyst poisoning components such as sulfur, nitrogen and the like must be treated.

DISCLOSURE

Technical Problem

Under such circumstances, the present inventors recognized the necessity for extracting aromatic components such as benzene, toluene, xylene and the like from LCO. Further, the present inventors recognized that a process of extracting high value-added olefins is also required in order to meet market demands. Based on these appraisals, the present invention was completed.

An object of the present invention is to provide a novel method of producing high-concentration aromatic products from FCC light cycle oil containing a large amount of high-aromaticity components, the light cycle oil being a new raw material replacing naphtha which is a conventional raw material used to produce aromatic products.

Mother object of the present invention is to provide a method of producing both high value-added olefin products and aromatic products to improve process efficiency.

Technical Solution

In order to accomplish the above objects, an aspect of the present invention provides a method of producing an aromatic product and an olefin product from a petroleum fraction obtained by fluid catalytic cracking, comprising the steps of: (a) cracking light cycle oil obtained by fluid catalytic cracking in the presence of a catalyst for catalytic cracking; (b) separating the cracked light cycle oil into an aromatic component selected from benzene, toluene and xylene, an olefin component, and an aromatic mixture having two or more aromatic rings; (c) hydrogenating the aromatic mixture having two or more aromatic rings in the presence of a catalyst for hydrogenation to partially saturate the two or more aromatic rings with hydrogen; and (d) recycling the hydrogenated aromatic mixture to mix the hydrogenated aromatic mixture with the light cycle oil introduced in the step (a).

Advantageous Effects

According to the present invention, aromatic products, such as benzene, toluene, xylene and the like, can be produced from light cycle oil obtained by FCC instead of naphtha which is a conventional raw material used to produce aromatic products, thus remarkably increasing the output of aromatic products. Further, according to the present invention, high value-added olefin products, such as propylene and the like, can be produced together with aromatic products, and thus it is possible to maximize overall process efficiency.

DESCRIPTION OF DRAWINGS

FIG. 1 is a schematic view showing a process of simultaneously producing aromatic products and olefin products from light cycle oil obtained by fluid catalytic cracking (FCC).

BEST MODE

Hereinafter, the present invention will be described in detail.

The method of producing an aromatic product and an olefin product from a petroleum fraction obtained by fluid catalytic cracking according to the present invention includes the steps of (a) cracking light cycle oil obtained by fluid catalytic cracking in the presence of a catalyst for catalytic cracking; (b) separating the cracked light cycle oil into an aromatic component selected from benzene, toluene and xylene, an olefin component, and an aromatic mixture having two or more aromatic rings; (c) hydrogenating the aromatic mixture having two or more aromatic rings in the presence of a catalyst for hydrogenation to partially saturate the two or more aromatic rings with hydrogen; and (d) recycling the hydrogenated aromatic mixture to mix the hydrogenated aromatic mixture with the light cycle oil introduced in step (a).

The method of producing an aromatic product and an olefin product from a petroleum fraction obtained by fluid catalytic cracking according to the present invention is characterized in that high value-added aromatic products, such as benzene, toluene, xylene and the like, and olefin products, such as ethylene and the like, are produced from light cycle oil having a high aromatic content and containing a large amount of impurities, the light cycle oil being separated from a distillate obtained by the fluid catalytic cracking of petroleum hydrocarbons.

The light cycle oil used in the present invention is produced by fluid catalytic cracking (FCC). FCC is a process of producing a light petroleum product using a distillate as a raw material under the conditions of a temperature of 500~700° C. and a pressure of 1~3 atms. In the FCC, a main product, such as a gasoline fraction, and side-products, such as propylene, heavy cracked naphtha (HCN), light cycle oil, slurry oil and the like are produced. The light cycle oil and the like, except for the gasoline fraction, produced in this process are separated in a distillation tower. Since the light cycle oil contains a large amount of impurities, heteroatomic compounds and aromatic compounds, it is difficult to use the light cycle oil as a light petroleum fraction which is a high value-added product, and it is generally used as high-sulfur light oil or low-priced heavy fuel oil.

The method according to the present invention is characterized in that high value-added aromatic products and olefin products, the demand for which is increasing, can be produced in high yield using the light cycle oil (LCO) obtained by FCC as a raw material.

In the method according to the present invention, in step (a), the light cycle oil obtained by fluid catalytic cracking (FCC) is cracked in the presence of a catalyst for catalytic cracking. The light cycle oil is a hydrocarbon mixture having an aromatic content of 70~80% and a boiling point of 170~360° C.

In step (a), the catalyst for catalytic cracking may be a spherical catalyst including at least one kind of porous solid acid. The porous solid acid suitably used in the present invention may include amorphous solid acid, such as silica, alumina or silica-alumina, and a crystalline zeolite molecular sieve having a molar ratio of Si/Al of 300 or less and a pore size of 4~10 Å (angstrom). Preferably, the crystalline zeolite molecular sieve may be a large-diameter zeolite molecular sieve having a large pore size of 6.5 Å or more, in the large-diameter pores of which aromatic components can easily react with each other. The crystalline zeolite molecular sieve may be selected from the group consisting of FAU, MOR and BEA, represented by Y (ReY or USY).

The spherical catalyst used in the catalytic cracking process is formed by mixing 10~95 wt % of the at least one kind of porous solid acid with 5~90 wt % of an organic binder and then spraying and drying the mixture to a particle size of 10~300 microns.

In step (b), the light cycle oil (LCO) cracked in step (a) is separated into aromatic components such as benzene, toluene and xylene, olefin components, and an aromatic mixture having two or more aromatic rings. Here, the high value-added aromatic components such as benzene, toluene and xylene, and the high value-added olefin components are recovered as products, and the aromatic mixture having two or more aromatic rings, which is not an intended product of the present invention, is introduced in step (c) in order to additionally treat this aromatic mixture. The aromatic mixture mostly includes bicyclic compounds and tricyclic compounds, but may include a small amount of monocyclic compounds.

In step (c), the aromatic mixture having two or more aromatic rings, separated in step (b), is hydrogenated in the presence of a catalyst for hydrogenation to partially saturate the two or more aromatic rings with hydrogen. The catalyst is used to saturate one aromatic ring of two aromatic rings of the aromatic mixture having two or more aromatic rings by hydrogenation, and includes at least one metal selected from group 6 metals and group 9 to 10 metals in the periodic table. Preferably, the catalyst may include at least one selected from the group consisting of nickel, cobalt, molybdenum, and tungsten.

Meanwhile, since the reaction mechanism in step (c) includes the step of saturating aromatic rings, similarly to the desulfurization or denitrification, impurities can be easily removed.

In step (d), the hydrogenated aromatic mixture, the aromatic ring compounds of which were partially saturated in step (c), is recycled such that it is mixed with the light cycle oil introduced in step (a). In the case where multi-ring compounds are partially saturated in step (c), when the partially saturated multi-ring compound is mixed with the LCO introduced in step (a) and then the catalytic cracking process is conducted in step (a), the production yield of aromatics, such as benzene, toluene and xylene, remarkably increases.

Hereinafter, the present invention will be described in more detail with reference to the accompanying drawing.

FIG. 1 is a schematic view showing a process of simultaneously producing aromatic products and olefin products from light cycle oil obtained by fluid catalytic cracking (FCC).

Referring to FIG. 1, Light Cycle Oil (LCO) 1, obtained by a fluid catalytic cracking process, is introduced in a catalytic cracking process 2, and is then separated into desired aromatic products and olefin products in the presence of a catalyst. The catalytic cracking process is conducted in the same manner as a typical fluid catalytic cracking process. The catalytic cracking process is conducted at a temperature of 420~800° C. and a pressure of 1~10 atms, preferably at a temperature of 480~700° C. and a pressure of 1~5 atms.

As the catalyst used in the catalytic cracking process 2, a spherical catalyst including at least one kind of porous solid acid may be used. The porous solid acid suitable for this process, as described above, may be amorphous solid acid, such as silica, alumina or silica-alumina, or may be a crystalline zeolite molecular sieve having a molar ratio of Si/Al of 300 or less and a pore size of 4~10 A Å (angstrom). As the crystalline zeolite molecular sieve, a large-diameter zeolite molecular sieve having a large pore size of 6.5 Å or more may be used in order that aromatic components react with each other in the pores. The crystalline zeolite molecular sieve may be selected from the group consisting of FAU, MOR and BEA, represented by Y (ReY or USY). The catalyst used in the catalytic cracking process is formed by mixing 10~95 wt % of the at least one kind of porous solid acid with 5~90 wt % of an organic binder and then spray and drying the mixture to a particle size of 10~300 microns.

In the catalytic cracking process, aromatic components of C9 to C15 present in LCO are converted into benzene, toluene and xylene by the removal of side chains from the aromatic components, and non-aromatic components present in LCO are converted into olefin components of C3 to C4 by the decomposition of the non-aromatic components.

Therefore, the gas and liquid fractions 3 obtained in the catalytic cracking process 2 are introduced in a fractional distillation process 4, and are then separated into i) an aromatic product 5 including benzene toluene and xylene, ii) a gaseous mixture 6 including olefins, and iii) aromatic mixture 7 having two or more aromatic rings which are unconverted into desired aromatics.

The aromatic mixture 7 having two or more aromatic rings is introduced in a process 8 of partially saturating aromatic rings by hydrogenation. In this process 8 of partially saturating aromatic rings by hydrogenation, the aromatic rings of the aromatic mixture 7 are partially saturated with hydrogen 9 in the presence of a catalyst, and thus the aromatic mixture 7 is converted into aromatic components having one aromatic ring. This process 8 of partially saturating aromatic rings by hydrogenation may be conducted under mild conditions in order to prevent aromatic rings from being entirely saturated or in order to prevent aromatic components from being decomposed by hydrogen. Specifically, the process 8 of partially saturating aromatic rings by hydrogenation may be performed at a temperature of 200~700° C. and a pressure of 10~200 atms, preferably at a temperature of 300~450° C. and a pressure of 30~120 atms. Further, the process 8 of partially saturating aromatic rings by hydrogenation may be performed at a space velocity of 0.1~6.0 $hr^{-1}$, preferably 0.5~2.0 $hr^{-1}$. Furthermore, the process 8 of partially saturating aromatic rings by hydrogenation may be performed at a hydrogen feed rate of 20~400 $m^3$/Bbl, preferably 140~280 $m^3$/Bbl.

The catalyst used in the process 8 of partially saturating aromatic rings by hydrogenation is used to saturate one aromatic ring of the two aromatic rings of the aromatic mixture 7 having two or more aromatic rings by hydrogenation, and includes at least one metal selected from group 6 metals, group 9 metals and 10 metals in the periodic table. The metal is at least one selected from the group consisting of nickel, cobalt, molybdenum, and tungsten.

When the aromatic mixture 10 having one aromatic ring, which has been partially saturated in the process 8 and then discharged, is mixed with the light cycle oil 1 introduced in the catalytic cracking process 2, the light cycle oil 1 is easily converted into the desired aromatic products 5, thus increasing the yield of the aromatic product 5. Therefore, in the present invention, the product obtained in the process 8 is recycled into feed of the catalytic cracking process 2.

MODE FOR INVENTION

Hereinafter, the present invention will be described in more detail with reference to the following Examples. However, these Examples are set forth only to illustrate the present invention, and the scope of the present invention is not limited thereto.

Example 1-1

As given in Table 1, among petroleum fractions obtained by fluid catalytic cracking, light cycle oil having a boiling point range of 170~360° C. was provided as a raw material. Since the physical properties, composition and yield of the light cycle oil obtained by fluid catalytic cracking can be changed depending on the operating conditions of fluidic catalytic cracking, the claims of the present invention are not limited.

TABLE 1

| Items | Raw material |
|---|---|
| Specific gravity (15/4° C.) | 0.953 |
| Sulfur (wtppm) | 4,820 |
| Nitrogen (wtppm) | 430 |
| Aromatics (wt %) | 75 |
| Distillation characteristics (D-86° C.) | |
| IBP | 155 |
| 5% | 192 |
| 10% | 202 |
| 30% | 243 |
| 50% | 302 |
| 70% | 328 |
| 90% | 348 |
| 95% | 353 |
| EP | 356 |

Example 1-2

In the process of FIG. 1, the catalytic cracking of the light cycle oil, given in Table 1 of Example 1-1, was conducted using a fluid catalytic cracker. The catalyst used in this catalytic cracking is a silica-alumina catalyst containing commercially available Y-type zeolite, the silica-alumina catalyst including 49% of alumina, 33% silica, 2% of rare earth, and an inorganic binder. In this case, the reaction temperature was 600° C., and the reaction pressure was 2.4 atms.

The reaction experiment was conducted under the conditions of 600° C., 2.4 kg/$cm^2$, Cat/Oil=10, WHSV=27.2 $hr^{-1}$ using a catalyst circulation fluidized-bed reactor (0.0125 mi.d.; 2.0 m high) which can accelerate a catalytic reaction and can continuously recycle a catalyst. The yield of the product obtained in this way is given in Table 2 below. From Table 2, it can be seen that the content of aromatics is high and that high value-added propylene is produced.

TABLE 2

| Yield (wt %) | Example 2 |
|---|---|
| H2 + C1 + C2 (Dry gas) | 7.9 |
| C3 (Propane) | 8.3 |
| C3= (Propylene) | 6.9 |
| C4/C4= (Butane and Butylene) | 11.0 |
| C5+ Non-Aro. | 5.3 |
| Benzene, Toluene, Xylene | 43.6 |
| C10+ Aromatics | 9.4 |
| Coke | 7.6 |
| Total | 100 |

Example 1-3

The product obtained in Example 1-2 was fractionated, and then a reaction experiment of partially saturating the aromatic ring of the fractionated product (C10+aromatic fraction) of 220° C. or more was conducted by adding hydrogen in the presence of a catalyst. The reaction experiment was conducted in a fixed-bed reactor equipped with a nickel-molybdenum catalyst. The conditions and results thereof are given in Table 3 below. From Table 3, it can be clearly seen that the amount of aromatic components having one aromatic ring was increased by hydrogenating aromatic components having two or more aromatic rings and thus partially saturating the aromatic rings thereof. From the results of this Example, since the reaction conditions and the characteristics of the reaction product can be changed depending on the kind of a commercially available catalyst, the claims of the present invention are not limited.

TABLE 3

| Type and amount of catalyst | $NiMo/Al_2O_3$/55 cc |
|---|---|
| Operating conditions | |
| Hydrogen partial pressure (kg/$cm^2$) | 100 |
| Gas/Oil, $Nm^3$/kl | 500 |
| LHSV, $hr^{-1}$ | 1.5 |

TABLE 3-continued

| Reaction temperature (° C.) | 300 | |
|---|---|---|
| Results of analysis of contents of aromatics | feedstock | products |
| Aromatic components having one aromatic ring (wt %) | 7.22 | 43.63 |
| Aromatic components having two aromatic rings (wt %) | 43.40 | 17.51 |
| Aromatic components having three or more aromatic rings (wt %) | 23.61 | 9.06 |
| Total amount of aromatics (wt %) | 74.33 | 70.20 |

The invention claimed is:

1. A method of producing an aromatic product and an olefin product from light cycle oil having a boiling point of 170-360° C. and an aromatic content of 70 wt % or more, comprising the steps of:

(a) cracking the light cycle oil in the presence of a cracking catalyst at a temperature of 420-800° C. and a pressure of 1-10 atms;

(b) separating the cracked light cycle oil into (i) an aromatic product comprising monocyclic aromatics of benzene, toluene and xylene, (ii) a gaseous mixture including olefins, and (iii) an aromatic mixture having a boiling point of 220° C. or more which comprises aromatics having two or more aromatic rings, and recovering (i) the aromatic product and (ii) the gaseous mixture;

(c) hydrogenating the aromatic mixture (iii) in the presence of a hydrogenation catalyst at a temperature of 200-700° C., a pressure of 10-200 atms and a hydrogen feed rate of 20-400 $m^3$/Bbl to partially saturate the two or more aromatic rings into one aromatic ring with hydrogen; and (d) recycling all of the hydrogenated aromatic mixture to mix the hydrogenated aromatic mixture with the light cycle oil to be cracked in the step (a);

wherein the cracking catalyst consists of a binder and a large pore zeolite molecular sieve having a pore size of 6.5 Å or more, and is selected from the group consisting of FAU, MOR and BEA, having an Si/Al molar ratio of 300 or less.

2. The method according to claim 1, wherein the cracking catalyst is a spherical catalyst.

3. The method according to claim 2, wherein the cracking catalyst is formed by mixing 10~95 wt % of at least one zeolite molecular sieve selected from the group consisting of FAU, MOR and BEA with 5~90 wt % of a binder selected from alumina and clay and then spraying and drying the mixture to a particle size of 10~300 microns.

4. The method according to claim 1, wherein the step (a) of cracking the light cycle oil is performed at a temperature of 480~700° C. and a pressure of 1~5 atms.

5. The method according to claim 1, wherein the catalyst used in the step (c) of hydrogenating the aromatic mixture includes at least one metal selected from group 6 metals, group 9 metals, and group 10 metals in the periodic table.

6. The method according to claim 1, wherein the hydrogenation catalyst includes at least one metal selected.

7. The method according to claim 1, wherein the step (c) of hydrogenating the aromatic mixture is performed at a temperature of 300~450° C. and a pressure of 30~120 atms and a hydrogen feed rate of 140-280 $m^3$/Bbl.

8. A method of producing an aromatic product and an olefin product from light cycle oil, comprising the steps of: p1 (a) cracking a feed consisting of light cycle oil having a boiling point of 170° C. to 360° C. and an aromatic content of 70 wt % or more in the presence of a cracking catalyst at a temperature of 420-800° C. and a pressure of 1-10 atms, to obtain cracked light cycle oil;

(b) separating the cracked light cycle oil into (i) an aromatic product comprising monocyclic aromatics of benzene, toluene and xylene, (ii) a gaseous mixture including olefins, and (iii) an aromatic mixture having a boiling point of 220° C. or more which comprises aromatics having two or more aromatic rings, and recovering (i) the aromatic product and (ii) the gaseous mixture (c) hydrogenating the aromatic mixture (iii) in the presence of a hydrogenation catalyst at a temperature of 200-700° C., a pressure of 10-200 atms and a hydrogen feed rate of 20-400 $m^3$/Bbl to partially saturate the two or more aromatic rings into one aromatic ring with hydrogen; and (d) recycling all of the hydrogenated aromatic mixture to mix the hydrogenated aromatic mixture with the feed in the step (a);

wherein the cracking catalyst consists of a binder and a large pore zeolite molecular sieve having a pore size of 6.5 Å or more, and is selected from the group consisting of FAU, MOR and BEA, having an Si/Al molar ratio of 300 or less.

* * * * *